US006654985B1

(12) United States Patent
Lu

(10) Patent No.: US 6,654,985 B1
(45) Date of Patent: Dec. 2, 2003

(54) PIVOT HINGE

(76) Inventor: Sheng-Nan Lu, No. 174, Chunying St., Shulin Chen, Taipei Hsien (TW)

( * ) Notice: Subject to any disclaimer, the term of this patent is extended or adjusted under 35 U.S.C. 154(b) by 0 days.

(21) Appl. No.: 10/158,835

(22) Filed: Jun. 3, 2002

(51) Int. Cl.[7] ..... E05D 11/08
(52) U.S. Cl. ..... 16/342; 16/338
(58) Field of Search ..... 16/342, 337, 338, 16/347, 340, 386; 361/681, 680; 403/65, 103, 83, 84, 145, 247, 297

(56) References Cited

U.S. PATENT DOCUMENTS 4,428,094 A * 1/1984 Emain ..... 16/228
4,490,884 A * 1/1985 Vickers ..... 16/338
5,409,122 A * 4/1995 Lazarus ..... 211/186
5,503,491 A * 4/1996 Lu ..... 403/86
5,632,066 A * 5/1997 Huong ..... 16/338
5,642,957 A * 7/1997 Lange ..... 403/297
5,774,939 A * 7/1998 Lu ..... 16/342
6,116,806 A * 9/2000 Chang ..... 403/145
6,317,927 B1 * 11/2001 Lai et al. ..... 16/342
6,473,938 B1 * 11/2002 Yoshigashima et al. ..... 16/342

* cited by examiner

*Primary Examiner*—Anthony Knight
*Assistant Examiner*—Michael J. Kyle
(74) *Attorney, Agent, or Firm*—Fei-Fei Chao; Venable LLP

(57) ABSTRACT

A pivot hinge has a first stem provided with a first connection plate, an extension integrally formed with the first connection plate and provided with a slit so defined to divide the extension into a first half and a second half, multiple annular grooves defined in an outer periphery of the extension and a threaded hole defined in the first half. A second stem has a second connection plate and a hollow sleeve integrally formed with the second connection plate and an arcuate cutout defined in an outer periphery of the hollow sleeve. A screw is able to extend into the threaded hole from the arcuate cutout to abut an inner periphery of the second half of the extension to enlarge the diameter of the extension so as to increase the engagement tightness between the extension and the hollow sleeve.

1 Claim, 5 Drawing Sheets

PIVOT HINGE

BACKGROUND OF THE INVENTION

1. Field of the Invention

The present invention relates to a pivot hinge, and more particularly to a pivot hinge having a first stem and a second stem. The first stem has an extension provided with a slit defined through the extension. The second stem has a hollow sleeve with an arcuate cutout peripherally defined in the sleeve. A screw is able to extend into the extension to enlarge the diameter of the extension in the sleeve after the extension is received in the hollow sleeve so as to adjust friction between the extension and the sleeve.

2. Description of Related Art

A conventional pivot hinge is composed of a bracket and a stem with a threaded end. The bracket has multiple washers provided on opposite sides of the bracket, a lubrication disk located outside the washer, multiple springs provided outside the lubrication disk, a positioning disk and a nut.

When the pivot hinge of this kind is to be assembled, the threaded end of the stem extends through the washers on one side of the bracket and the washers on the other side of the bracket, the lubrication disk, the springs, the positioning disk and into the nut to be screwingly connected to the nut. It is noted from the structure that when the stem pivots relative to the bracket, the friction required comes from the engagement between the bracket and the washers. Because the washers are completely in engagement with the bracket, the friction therebetween will gradually wear the washers, which leads to a short life span of the pivot hinge. Furthermore, due to the wear of the washers, the tightness off the engagement between the bracket and the washers becomes loose and therefore the friction is not enough when required.

To overcome the shortcomings, the present invention tends to provide an improved pivot hinge to mitigate and obviate the aforementioned problems.

SUMMARY OF THE INVENTION

The primary objective of the present invention is to provide an improved pivot hinge which is able to adjust the friction between the sleeve and the extension so that the friction between the extension and the sleeve is maintained.

In order to accomplish the foregoing objective, the pivot hinge of the present invention has a first stem with an extension and a second stem with a hollow sleeve and an arcuate cutout peripherally defined in the hollow sleeve. A slit is defined to divide the extension to two symmetric halves. A threaded hole is defined in either one of the two halves of the extension to allow the extension of a screw such that after the extension is received in the hollow sleeve, the screw extends into the threaded hole from the arcuate cutout and abuts an inner periphery of the extension. Screwing the screw in the extension will then enlarge the diameter of the extension so as to increase the engagement tightness between the extension and the sleeve as well as the friction therebetween.

Other objects, advantages and novel features of the invention will become more apparent from the following detailed description when taken in conjunction with the accompanying drawings.

DETAILED DESCRIPTION OF THE PREFERRED EMBODIMENT

Figure 1:
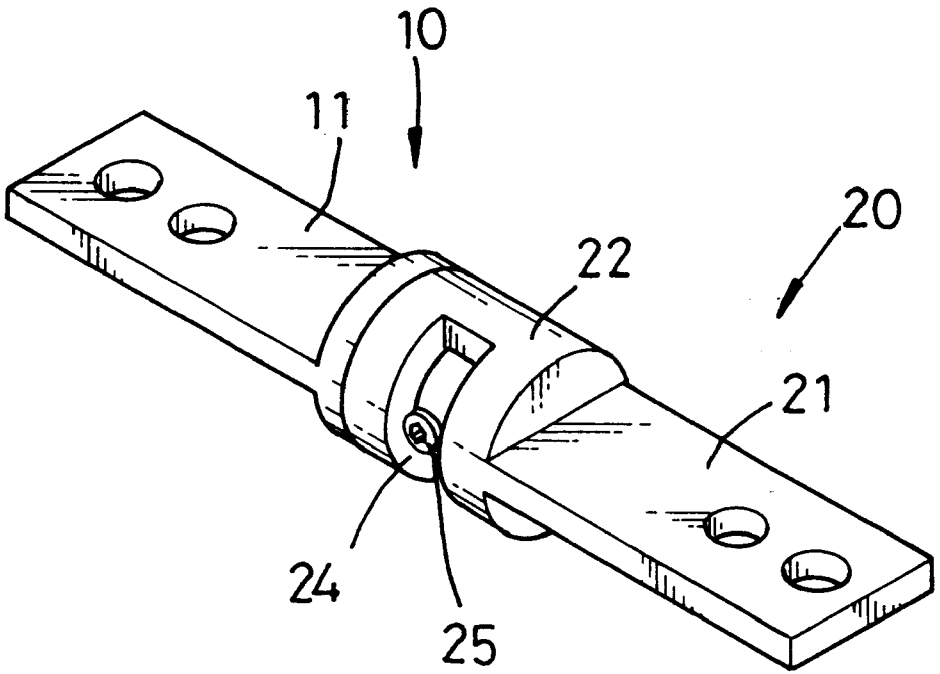
FIG. 1 is a perspective view of the pivot hinge of the present invention.
Figure 2:
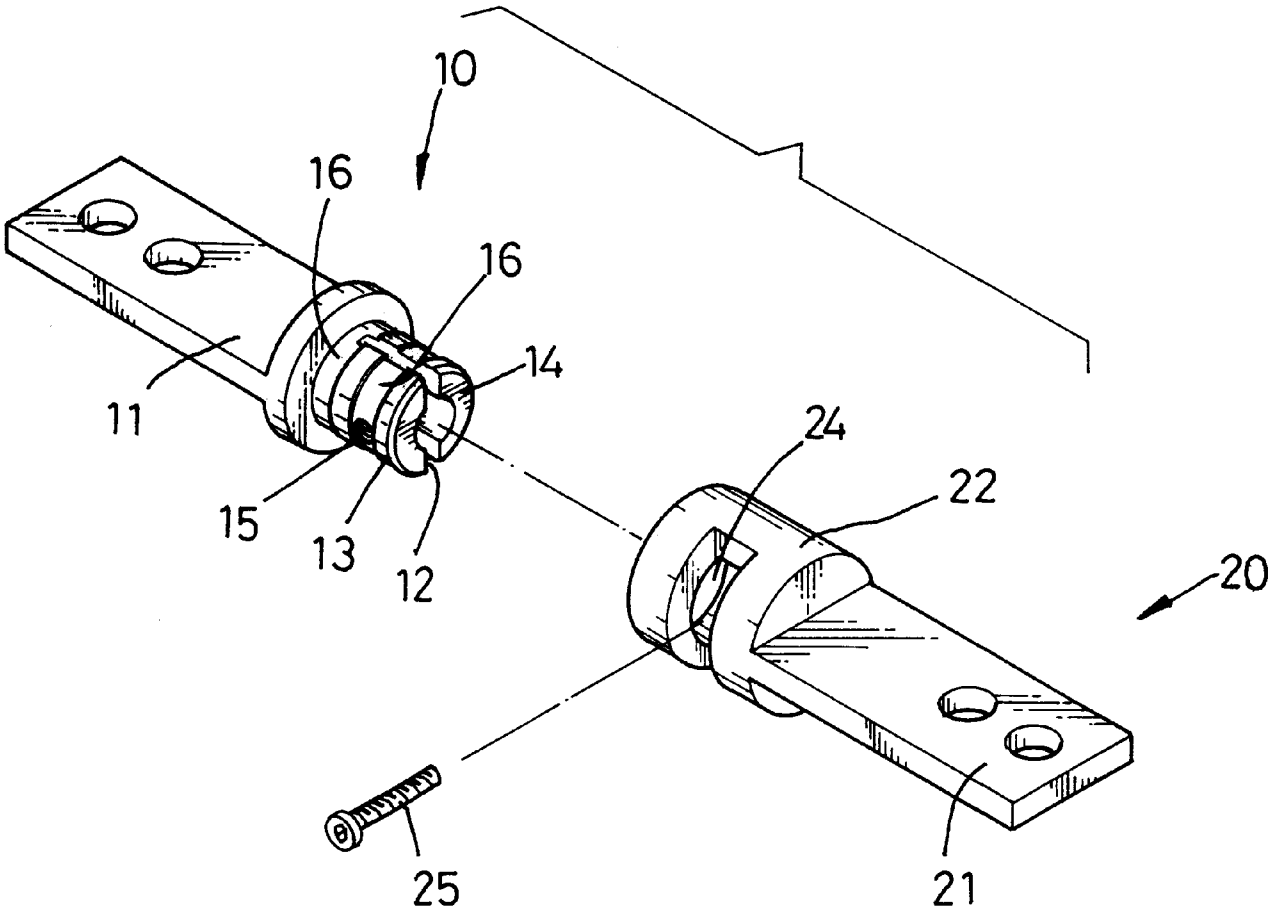
FIG. 2 is an exploded perspective view of the pivot hinge shown in FIG. 1.
Figure 3:
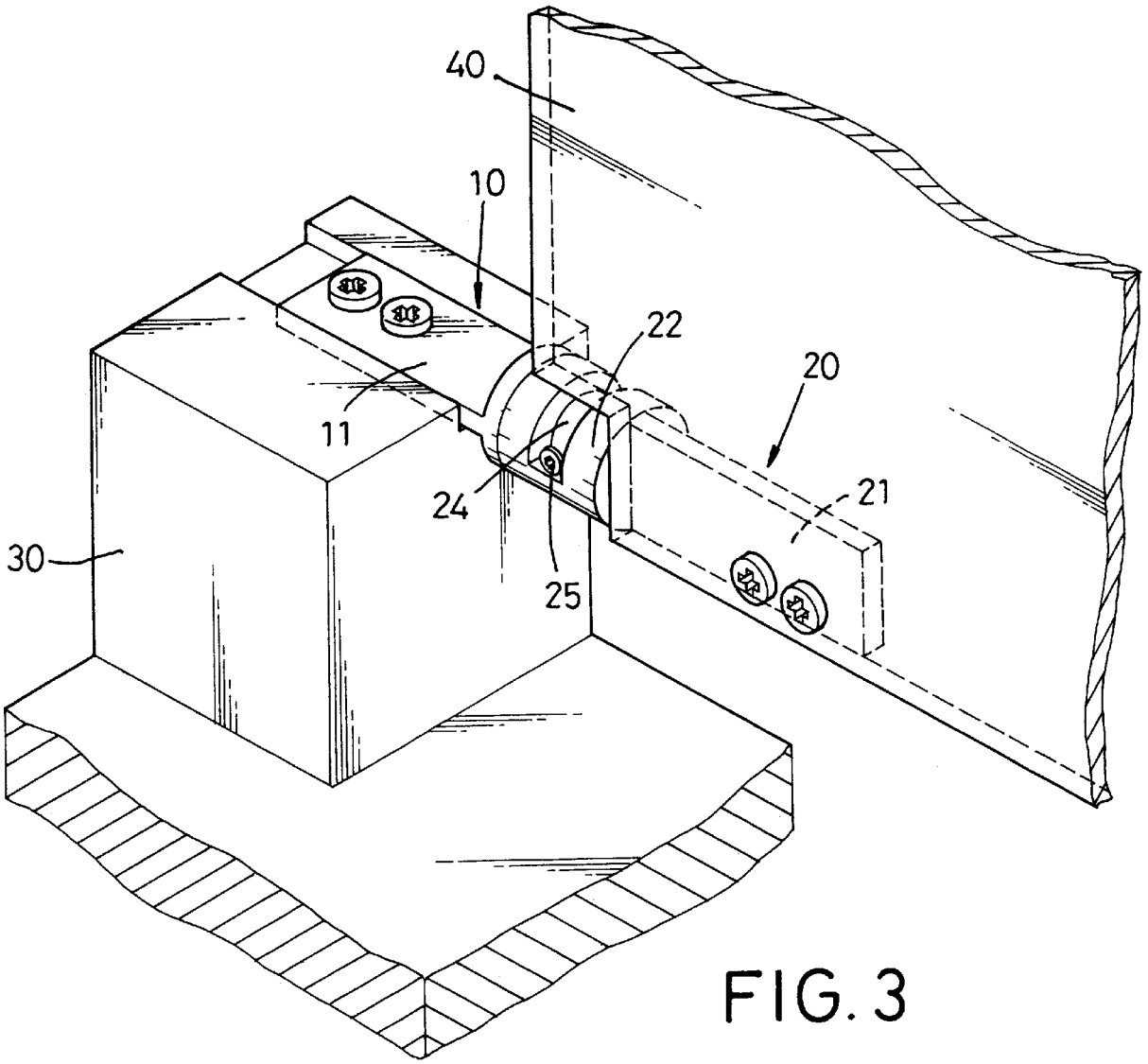
FIG. 3 is a schematic view showing the application of the pivot hinge of the present invention.

With reference to FIGS. 1 and 2, the pivot hinge in accordance with the present invention is composed of a first stem (10) and a second stem (20) respectively adapted to connect to a screen (40) and a frame (30) of a laptop, as shown in FIG. 3.

The first stem (10) has a first connection plate (II), an extension integrally formed with the first connection plate (11) and provided with a slit (12) so defined to divide the extension into a first half (13) and a second half (14), multiple annular grooves (16) defined in an outer periphery of the extension and a threaded hole (15) defined in the first half (13).

The second stem (20) has a second connection plate (21) and a hollow sleeve (22) integrally formed with the second connection plate (21) and an arcuate cutout (24) defined in an outer periphery of the hollow sleeve (22).

When the pivot hinge of the present invention is to be assembled, the extension is inserted into the hollow sleeve (22) so as to have an interference fit with the hollow sleeve (22). Then a screw (25) is inserted into the threaded hole (15) from the arcuate hole (24).

Figure 4:
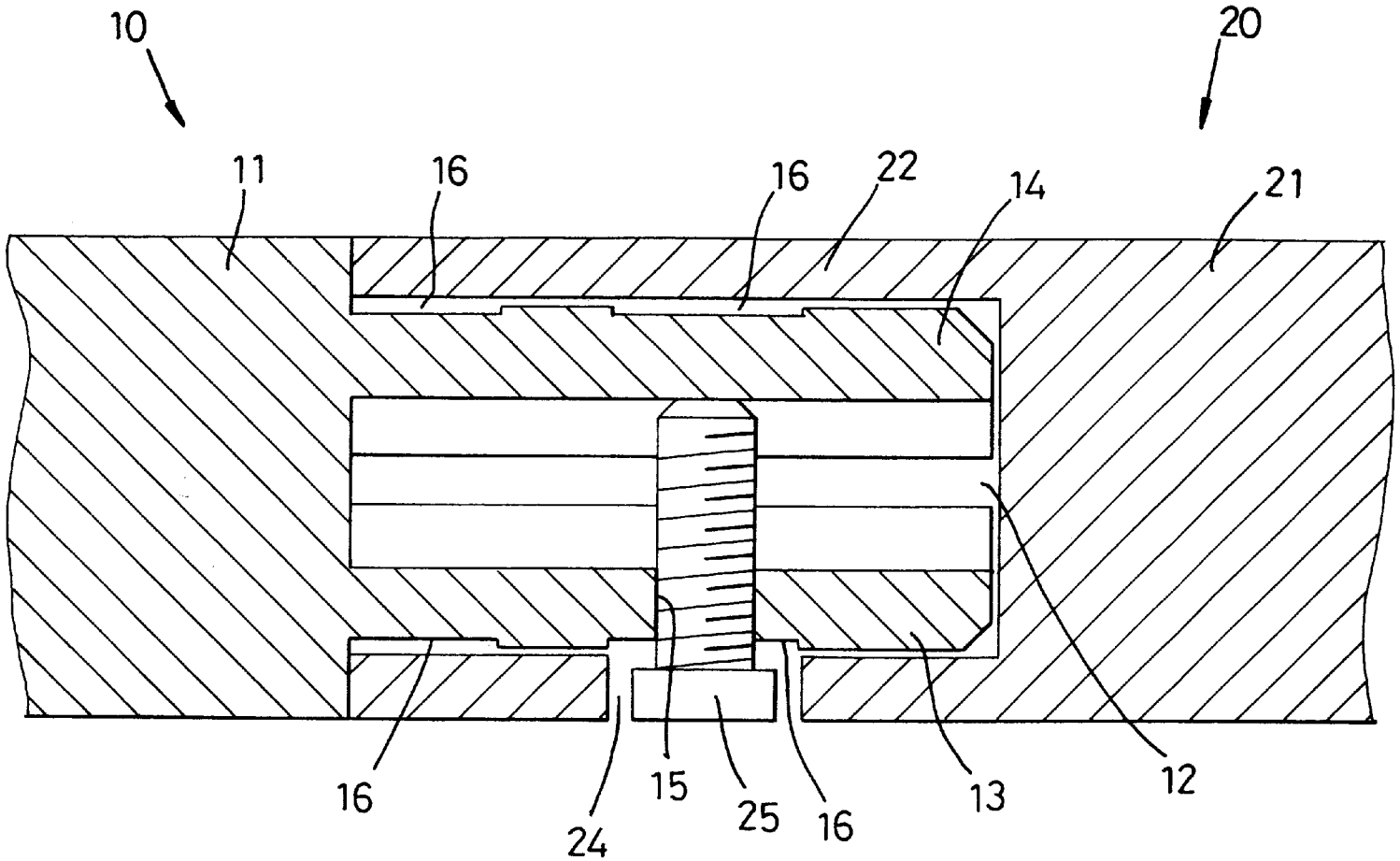
FIG. 4 is a cross sectional view showing the engagement between the extension and the sleeve.
Figure 5:
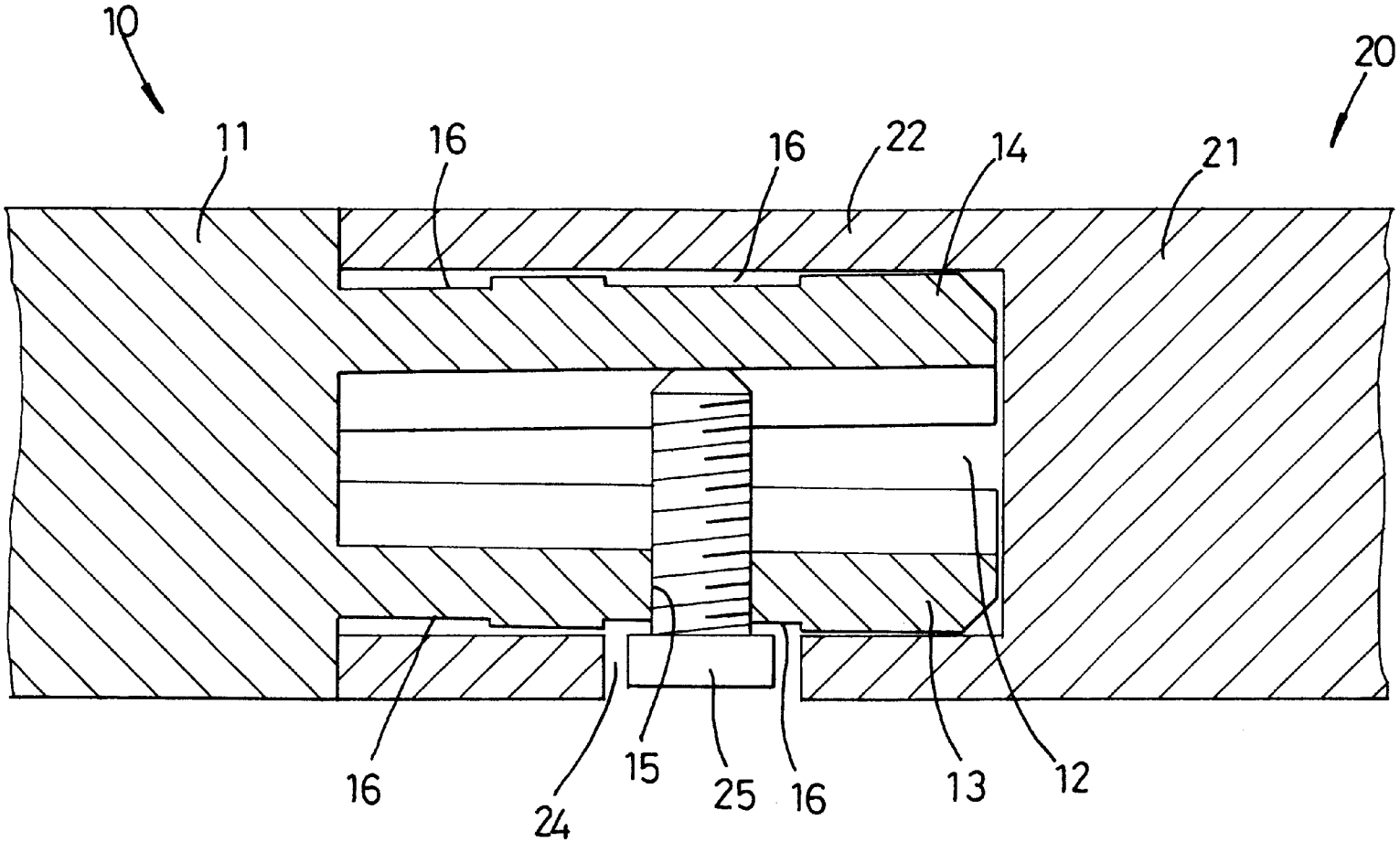
FIG. 5 is a cross sectional view showing the adjustment of the screw to enlarge the diameter of the extension in the sleeve.

With reference to FIG. 4, after the screw (25) is inserted into, the threaded hole (15) from the arcuate hole (24), the distal end of the screw (25) abuts an inner periphery of the second half (14). With reference to FIG. 5, when the interference fit between the extension and the hollow sleeve (24) is loose as a result of gradual wearing of the extension as well as the hollow sleeve (22), the user is able to turn the screw (25) to urge further against the second half and so enlarge the diameter of the extension so as to increase the engagement tightness between the extension and the hollow sleeve (22). With such an adjustment mechanism, the pivot hinge is able to maintain its friction output so as to maintain the screen (40) at any angle relative to the frame (30).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pivot hinge comprising:

a first stem having a first connection plate, an extension integrally formed with the first connection plate and provided with a slit so defined to divide the extension into a first half and a second half, multiple annular grooves defined in an outer periphery of the extension and a threaded hole laterally defined in the first half;

a second stem having a second connection plate and a hollow sleeve integrally formed with the second connection plate to correspond to the extension of the first stem and an arcuate cutout defined in an outer periphery of the hollow sleeve; and a screw inserted into the threaded hole from the arcuate cutout of the second stem to abut an inner periphery of the second half of the first stem, whereby screwing the screw in a direction perpendicular to an orientation of the extension enlarges a diameter of the extension so as to increase engagement tightness between the extension and the hollow sleeve.

* * * * *